US005402923A

United States Patent [19]

Snyder

[11] Patent Number: 5,402,923

[45] Date of Patent: Apr. 4, 1995

[54] DEVICE FOR THE HOLDING AND TRANSPORT OF GOLF CLUBS

[76] Inventor: Morris E. Snyder, P.O. Box 871, Washington, N.C. 27889

[21] Appl. No.: 909,003

[22] Filed: Jul. 6, 1992

[51] Int. Cl.[6] ..... A45F 3/02; A63B 55/00

[52] U.S. Cl. ..... 224/202; 224/208; 224/264; 206/315.3; 206/315.6

[58] Field of Search ..... 224/202, 201, 205, 206, 224/208, 260, 266, 265, 264; 206/315.2, 315.3, 315.6, 315.7, 315.8

[56] References Cited

U.S. PATENT DOCUMENTS

| | | | |
|---|---|---|---|
| D. 302,073 | 7/1989 | Biggs | 224/266 |
| 464,380 | 12/1891 | McClay . | |
| 1,281,822 | 10/1918 | Orr | 224/205 |
| 1,563,816 | 12/1925 | Worthington | 206/315.2 |
| 2,422,315 | 6/1947 | Robinson | 206/315.7 |
| 2,732,871 | 1/1956 | Drown . | |
| 3,564,590 | 2/1971 | Hebel . | |
| 3,779,297 | 12/1973 | Stammer | 206/315.6 |
| 4,260,088 | 4/1981 | Buckner . | |
| 4,911,347 | 3/1990 | Wilhite . | |
| 4,924,682 | 5/1990 | Penner | 206/315.3 |
| 5,129,560 | 7/1992 | Herman | 224/151 |

FOREIGN PATENT DOCUMENTS

| | | | |
|---|---|---|---|
| 2598603 | 11/1987 | France | 224/265 |

*Primary Examiner*—Linda J. Sholl
*Attorney, Agent, or Firm*—Norman B. Rainer

[57] ABSTRACT

A golfbag which is easy to carry is constructed of two substantially identical tubular containers having open upper extremities and closed lower extremities. The upper extremities are joined by a shoulder strap, and the lower extremities are joined by a connecting member, thereby defining a closed loop region. The size of the closed loop region is such as to enable the golfbag to be worn diagonally from one shoulder to a location below the waist opposite said shoulder.

6 Claims, 2 Drawing Sheets

DEVICE FOR THE HOLDING AND TRANSPORT OF GOLF CLUBS

BACKGROUND OF THE INVENTION

1. Field of the Invention

This invention relates to golfbags, and more particularly concerns a golfbag which affords greater comfort to the golfer who carries the golfbag.

2. Description of the Prior Art

Golfbags intended to be carried by a golfer during the playing of the game of golf are generaliT comprised of an elongated tubular container having an open upper extremity, closed lower extremity, and a carrying strap attached to both extremities. In use, the carrying strap is looped around the golfer's shoulder, or worn diagonally across the chest, either mode disposing the container upon the golfer's back.

Because several clubs are carried in said container, the fully loaded golfbag is heavy, and its carrying by the golfer is a tiresome task. The carrying of the loaded golfbag is particularly fatiguing because of the uneven distribution of its weight.

There are numerous disclosures of improved golfbags which afford greater comfort to the golfer. However, most of said disclosures relate to innovations in strap design, and do not address the problem of the uneven weight distribution of the loaded golfbag.

A carrying device is disclosed in U.S. Pat. No. 3,564,590 wherein the weight of the loaded device is distributed between the back and side of the user. Such device would not, however, be useful in carrying elongated objects such as golf clubs.

It is accordingly an object of the present invention to provide a golf bag which can be more comfortably carried by the golfer.

It is another object of this present invention to provide a golf bag of the aforesaid nature which disposes the weight of the golfbag evenly upon the front and rear of the golfer.

It is a further object of the invention to provide a golfbag of the aforesaid nature which enables the golfbag to be supported by one of the golfer's shoulders and an opposite hand.

Still further objects of this invention are to provide a golfbag of the aforesaid nature of rugged, durable construction and amenable to low cost manufacture.

These and other beneficial objects and advantages will be apparent from the following description.

SUMMARY OF THE INVENTION

The above and other beneficial objects and advantages are accomplished in accordance with the present invention by a golfbag comprised of:

a) paired tubular containers, each having an open upper extremity and closed lower extremity, b) a shoulder strap attached to said upper extremities, and c) a connecting member extending between said lower extremities in substantially coplanar relationship with said shoulder strap, and defining with said containers and shoulder strap a closed loop region.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED

Figure 1:
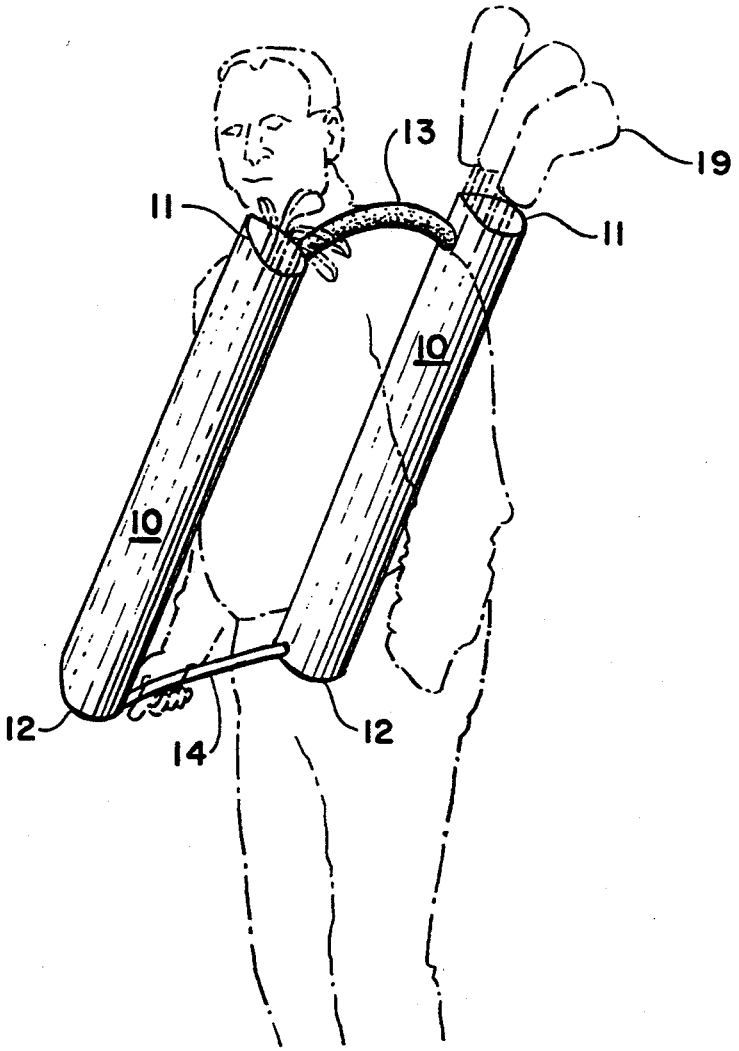
FIG. 1 is a perspective view of an embodiment of the golfbag of this invention, shown with golf clubs and operatively disposed upon a golfer.
Figure 2:
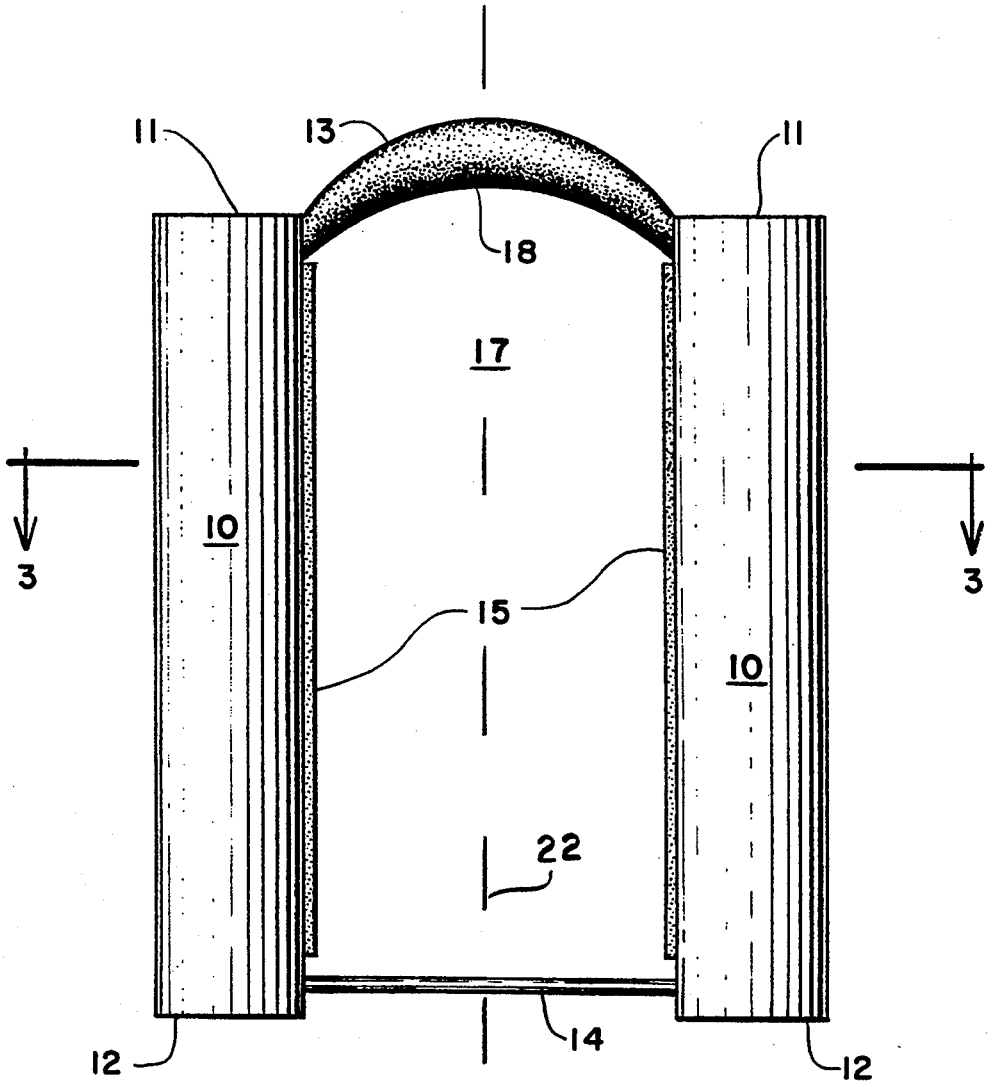
FIG. 2 is a side view of the golfbag of FIG. 1.
Figure 3:
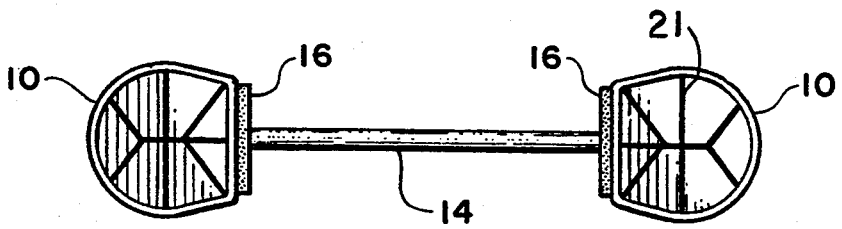
FIG. 3 is a sectional view taken in the direction of the arrows upon line 3–3 of FIG. 2.

Referring to FIGS. 1–3, an embodiment of the golfbag of this invention is shown comprised of paired identical elongated tubular containers 10 having open upper extremities 11 and closed ower extremities 12. A shoulder strap 13 is attached to said upper extremities. A connecting member 14, having a length substantially equal to the length of said shoulder strap, extends between lower extremities 12 in substantially parallel and coplanar relationship with the shoulder strap.

Containers 10 may be of rigid, semi-rigid, or compliant construction, and fabricated of lightweight, strong materials. In a preferred embodiment, the facing side portions 15 of the containers are substantially rigid and hold exteriorly disposed cushioning material 16. The length of the containers measured between said extremities, may range from about 32 to 36 inches. The diameter of the containers may range from about 6 to 8 inches. Each container is preferably compartmented by way of divider strips 21.

Connecting member 14, side portions 15, and shoulder strap 13 define a closed loop region 17 dimensioned such that the golfbag can be worn by the golfer as shown in FIG. 1. In such manner of use, shoulder strap 13 rests upon the golfers shoulder, side portions 15 lie against the golfer's chest and back in parallel opposition, and connecting member 14 is disposed at a location below the golfer's waist in diagonal opposition to that shoulder which supports shoulder strap 13. Connecting member 14 is preferably fixedly attached to the containers, and thereby serves as a handle to which the golfer may apply lifting force to counteract the downward force borne by the shoulder.

The golfbag is seen to have a centered line of symmetry 22. In some embodiments, the containers may be fabricated of plastic or metal. Shoulder strap 13 is preferably of wide construction, and provided with cushioning material 18 directed inwardly with respect to loop region 17. The containers may also be equipped with fold-away support members which enable the golf bag to be self-standing in upright position.

By virtue of the aforesaid manner of construction, a heavy load of golf clubs 19 can be carried in relative comfort because the total weight is symmetrically distributed upon the golfer from front to rear and side to side.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A golfbag comprised of:

a) paired tubular containers, each having an open upper extremity and closed lower extremity, b) a shoulder strap attached to said upper extremities, and c) a connecting member extending between said lower extremities in substantially coplanar relationship with said shoulder strap, and defining with said containers and shoulder strap a closed loop region having a size large enough to enable the golfbag to be worn by a golfer in diagonal disposition from one shoulder to a location below the waist opposite said shoulder.

2. The golfbag of claim 1 wherein said containers are of identical construction.

3. The golfbag of claim 2 wherein each container has a substantially rigid side portion which holds exteriorly disposed cushioning material.

4. The golfbag of claim 3 wherein the containers have a diameter between 6 and 8 inches, and a length between 32 and 36 inches.

5. The golfbag of claim 2 wherein said shoulder strap is provided with cushioning material directed inwardly with respect to said loop region.

6. The golfbag of claim 2 having a centered line of symmetry.

* * * * *